US009557143B2

(12) United States Patent
Howland

(10) Patent No.: US 9,557,143 B2
(45) Date of Patent: Jan. 31, 2017

(54) INTEGRATED PROTECTIVE GARMENT ENSEMBLE

(71) Applicant: WARWICK MILLS, INC., New Ipswich, NH (US)

(72) Inventor: Charles A Howland, Temple, NH (US)

(73) Assignee: Warwick Mills Inc., New Ipswich, NH (US)

( * ) Notice: Subject to any disclaimer, the term of this patent is extended or adjusted under 35 U.S.C. 154(b) by 324 days.

(21) Appl. No.: 14/207,737

(22) Filed: Mar. 13, 2014

(65) Prior Publication Data

US 2014/0331375 A1 Nov. 13, 2014

Related U.S. Application Data

(60) Provisional application No. 61/779,288, filed on Mar. 13, 2013.

(51) Int. Cl.

| | |
|---|---|
| ***F41H 1/02*** | (2006.01) |
| ***A41D 1/02*** | (2006.01) |
| ***A41D 1/04*** | (2006.01) |
| ***A41D 1/06*** | (2006.01) |

(52) U.S. Cl.

CPC *F41H 1/02* (2013.01); *A41D 1/02* (2013.01); *A41D 1/04* (2013.01); *A41D 1/06* (2013.01); *Y10T 428/192* (2015.01); *Y10T 428/24612* (2015.01)

(58) Field of Classification Search

CPC ..... A41D 1/02; A41D 1/04; A41D 1/06; F41H 1/02; Y10T 428/192; Y10T 428/24612

USPC ..... 2/2.5; 89/36.02, 36.01, 36.05, 921, 917; 428/911, 920, 98–113; 442/135

See application file for complete search history.

(56) References Cited

U.S. PATENT DOCUMENTS

| | | | |
|---|---|---|---|
| 5,634,215 | A | 6/1997 | DeBaene |
| 6,705,197 | B1 | 3/2004 | Neal |
| 2011/0296979 | A1 | 12/2011 | Howland |
| 2012/0159680 | A1 | 6/2012 | Howland |

FOREIGN PATENT DOCUMENTS

| | | | |
|---|---|---|---|
| WO | 0129299 | A2 | 4/2001 |

OTHER PUBLICATIONS

PCT Search Report & Written Opinion dated Jul. 30, 2014 of Patent Application No. PCT/US2014/025267 filed Mar. 13, 2014, 15 pages.

*Primary Examiner* — Arti Singh-Pandey
(74) *Attorney, Agent, or Firm* — Maine Cernota & Rardin

(57) ABSTRACT

A protective garment system fabricated from ballistic textiles having a V50 on 2 grain RCC of at least 300 fps as measured by Mil-Spec 662F provides good ballistic and fragmentary protection, and can be worn in lieu of conventional clothing without discomfort to the wearer. Embodiments overcome prior art ballistic fabric limitations by incorporating novel construction, such as plaiting and/or twill or satin weaving, as well as novel yarn selection, to enable comfortable skin contact, and by applying coatings to improve abrasion resistance, UV resistance, and color acceptance. Embodiments incorporate layers of ballistic fabric in critical areas, either by overlapping protective clothing articles, and/or by incorporating multiple layers of protective fabric into an individual protective garment. Embodiments provide good moisture transport for long term comfort. In certain embodiments, substantially all of the garment's mass is protective, including pockets, lapels, load carriage, and any other "folded" features.

18 Claims, 15 Drawing Sheets

INTEGRATED PROTECTIVE GARMENT ENSEMBLE

RELATED APPLICATIONS

This application claims the benefit of U.S. Provisional Application No. 61/779,288, filed Mar. 13, 2013, which is herein incorporated by reference in its entirety for all purposes.

FIELD OF THE INVENTION

The invention relates to body armor, and more particularly, to body armor that incorporates protective fabrics.

BACKGROUND OF THE INVENTION

The variety and types of threats encountered by soldiers in combat, as well as by law enforcement officers and others, continues to expand. Also, it can be difficult to be certain when circumstances are "safe," and when combat may be imminent.

Soldiers have long worn protective armor to offset many kinds of ballistic and fragmentary threats. Such armor typically is worn over the user's clothing as one or more add-on pieces supported by a separate non-protective textile carrier, with protective elements often being inserted into a non-protective textile slip cover of the textile carrier. Typically, such body armor includes thick, rigid panels, and is too bulky, heavy, and inflexible to be worn at all times. Moisture transport can also be quite low for such armor, making the armor uncomfortable to wear for extended periods. And the added heat retention due to wearing the body armor on top of conventional clothing can result in significant heat stress for the user. As a result, conventional body armor is not always worn when it is needed.

Protective textiles can be produced by including protective fibers in a fabric, where the protective fibers have an average tenacity of at least 12 gpd. However, such protective textiles have not previously been used to fabricate garments that offer protection from ballistic and fragmentary threats. This is due to several garment-incompatible qualities that have been generally associated with protective fabrics, such as poor hand, poor acceptance of coloring, low abrasion resistance, and poor UV resistance. Instead, protective fabrics have generally been relegated to armor configurations that are worn over conventional clothing, and typically include a non-ballistic covering layer of conventional fabric to prevent UV and abrasion damage to the protective fabric, and to provide a desired visual color or pattern.

What is needed, therefore, is a body armor solution that provides good ballistic and fragmentary protection while maintaining good moisture transport, without subjecting the user to added weight, bulk, or heat stress, thereby allowing the body armor to be comfortably worn at nearly all times and under nearly all circumstances.

SUMMARY OF THE INVENTION

This present invention is a protective garment system that provides good ballistic and fragmentary protection, and can be worn in lieu of conventional clothing without any added discomfort to the wearer. The protective garment system is fabricated from protective textiles that provide protection from ballistic, fragmentary, blast, cut, and abrasion threats from many sources. In embodiments, the protective garment system incorporates layers of ballistic fabric into one or more garments, such as a t-shirt, undergarment, shirt, pant, jacket, and/or a textile assembly to incorporate load carriage. In some of these embodiments, a plurality of protective layers is provided by overlapping protective articles of clothing, such as a shirt worn over a T-shirt. In other embodiments, individual protective garments are fabricated using multiple layers of protective fabrics in certain areas of the body to provide enhanced protection where needed.

The fabrication of ballistic textiles into garments is unique to the present invention, in that no slip cover or other non-protective cover layer is needed, and because the protective garment ensemble is similar to a typical non-protective clothing ensemble in weight, drape, durability, moisture permeability, and overall comfort, so that the garments of the present invention can be worn for extended periods instead of, rather than in addition to, conventional clothing. Each of the technical obstacles that previously prevented the fabrication of otherwise conventional clothing from protective fabrics is overcome by the present invention. These obstacles included poor hand, poor abrasion resistance, poor color acceptance, and poor UV resistance.

The features of the present invention that overcome each of these obstacles include special fiber selections, weave patterns, and/or fabric coatings. According to the embodiment, good hand is provided by constructing the protective fabric with a mid-range cover factor, and in some embodiments with a long-float weave such as a twill or satin weave. Good abrasion resistance, good color acceptance, and good UV resistance is provided by one or more fabric coatings applied to the protective textile, which fully and uniformly cover the fibers in the fabric yarns. The coating or coatings have wash-fast adhesion to the fibers, without significantly increasing the stiffness of the fabric. These features are described in more detail below.

A key element of the present invention is that embodiments of the garment ensemble have little or no "parasitic" mass, in that all of the garment system's mass is protective. This efficient use of garment mass is especially important to military and other uniformed personnel who have high carry-mass burdens, and cannot accept additional carry-mass to provide added protection, for example to protect extremities.

Many uniformed personnel also have issues with heat stress. The present invention avoids the added heat stress that would result from wearing extra layers of non-protective textile under and over the protective armor, because the present invention replaces conventional clothing and does not require additional non-protective fabric to be worn either under or over the protective clothing. Accordingly, each layer in the ensemble is protective, and no unnecessary heat stress is created.

One general aspect of the present invention is a protective garment that includes a garment made exclusively from protective textiles, including at least one protective textile layer having a V50 on 2 grain RCC of at least 300 fps as measured by Mil-Spec 662F, said protective textile layer not including a slip cover element nor a carrier element, said garment being a T-Shirt, shirt, or jacket, and at least one layer of polymeric or elastomeric coating that encapsulates substantially all of the protective yarns.

In embodiments, at least 20% of the fabric yarns have an average tenacity greater than 10 gpd. In some embodiments, at least 25% of the fabric yarns have an average tenacity of greater than 10 gpd. Other embodiments further include a color-accepting coating applied to the protective textile layer that facilitates attachment of a pigment thereto.

In various embodiments the protective textile layer has a Ref of less than 20 Pa*m2/W. In certain embodiments the protective textile layer has a circular bend of less than 15 lbf. And in further embodiments the protective textile layer includes both staple yarns and filament yarns.

Embodiments further include a reinforcing textile layer overlapping at least a portion of the protective textile layer, said reinforcing textile layer having a V50 on 2 grain RCC of at least 350 fps as measured by Mil-Spec 662F.

In some embodiments, the protective textile can be dyed to a color having luminosity L less than 70. In other embodiments at least one of the protective textile layers has an areal density of less than 10 oz/yd2.

In various embodiments the protective textile layer is incorporated into a carrier for a ballistic or stab protection vest.

In certain embodiments the garment further includes a sewn or bonded doubling feature that is one of a collar, a pleat, a canvas, a lapel, a gusset, applique, or a pocket, said doubling feature being constructed from yarns that are similar in composition and properties to the fabric yarns of the protective textile layer.

In further embodiments the protective textile layer has a frazier perm of greater than 10 ft3/ft2/min.

In embodiments, at least one of the protective textiles has abrasion resistance greater than 1,000 cycles against 400 grit using the ASTM D4966 Martindale abrasion method And in some embodiments, at least one of the textile layers has AATCC method 100 anti-microbial properties.

Another general aspect of the present invention is a protective garment that includes a garment made exclusively from protective textiles, the garment including at least one protective textile layer, having a V50 on 2 grain RCC of at least 300 fps as measured by Mil-Spec 662F, said protective textile layer not including a slip cover element nor a carrier element; said garment being constructed as an undergarment or pant.

In embodiments, the protective textile layer has a Ref of less than 20 Pa*m2/W. In some embodiments, at least one of the protective textiles is constructed of yarns wherein at least 20% of the yarns are protective yarns having tenacity greater than 10 gpd.

In other embodiments, the protective textile layer has a circular bend of less than 15 lbf. In various embodiments, the protective textile layer has a frazier permeability of greater than 10 ft3/ft2/min.

In certain embodiments the garment further includes a doubling feature that is a sewn or bonded applique-type pocket, said doubling feature being constructed from yarns that are similar in composition and properties to the fabric yarns of the protective textile layer.

In further embodiments the garment further includes a doubling feature that is one of a pleat, a gusset, or a pocket, said doubling feature being constructed from yarns that are similar in composition and properties to the fabric yarns of the protective textile layer.

In embodiments, the protective textile can be dyed to a color having luminosity L less than 70. In some embodiments at least one of the protective textiles has abrasion resistance greater than 1,000 cycles against 400 grit using the ASTM D4966 Martindale abrasion method.

In other embodiments at least one of the protective textiles has AATCC method 100 anti-microbial properties. And in various embodiments at least one of the protective textiles has an areal density of less than 10 oz/yd2.

Still another general aspect of the present invention is a protective garment that includes a protective textile layer that includes protective yarns, and a cut-away strip included in the protective layer having an ASTM F1790 cut resistance of less than 1000 g, said cut-away strip being surrounded on both sides by adjacent segments of the protective textile layer, so that cutting of the cut-away strip facilitates removal of the protective garment from a user, said protective textile layer having a 2 gr RCC V50 of greater than 300 fps.

In embodiments, the protective textile layer has at least one layer of polymeric or elastomeric coating that encapsulates substantially all of the protective yarns.

In some embodiments, at least one of the textile layers is a knit that is plied with a plurality of yarns, at least one of said yarns being a staple yarn. In other embodiments the cut-away strip has a width that is more than ⅝ inches. In various embodiments the cut-away strip has a width that is not more than 2 inches.

In certain embodiments, a protective textile is defined as a textile constructed from fabric yarns, at least 20% of which are protective yarns having tenacity greater than 10 gpd. In further embodiments the cut-away strip is not bonded to any other fabric at its top or bottom, so that the segments of the protective textile layer that are adjacent to the cut-away layer can be separated from each other by cutting the cut-away fabric.

In further embodiments the cut-away strip can be cut by an EMI bandage scissor. In some embodiments the protective textile layer has a Ref of less than 20 Pa*m2/W. In other embodiments the protective textile layer has a circular bend of less than 15 lbf.

In various embodiments at least one of the protective textiles has an areal density of less than 10 oz/yd2.

In certain embodiments the garment further includes a doubling feature that is a sewn or bonded applique-type pocket, said doubling feature being constructed from yarns that are similar in composition and properties to the fabric yarns of the protective textile layer.

In embodiments, the garment further includes a doubling feature that is one of a pleat, a gusset, or a pocket, said doubling feature being constructed from yarns that are similar in composition and properties to the fabric yarns of the protective textile layer.

In some embodiments the protective textile layer can be dyed to a color having luminosity L less than 70. In other embodiments the protective textile layer has an areal density of less than 10 oz/yd2.

Yet another general aspect of the present invention is a garment ensemble configured to cover a chest, back, thigh, and butt area of a user. The garment ensemble includes a plurality of textile layers, configured such that no textile layer covering the chest, back, thigh, or butt area provides less than 300 fps V50 protection against 2 gr RCC fragment tested per Mil-Std 662F, and at least 2 protective layers in the ensemble having greater than 2 gr RCC 300 fps V50, each of the textile layers having a conformal coating layer.

In embodiments, the garment ensemble can be dyed to a color having luminosity L less than 70. In some embodiments, at least one of the textile layers is a knit that is plied with a plurality of yarns, at least one of said yarns being a staple yarn. In other embodiments, at least one of the textile layers is a knit that is plied with a plurality yarns, at least some of said yarns being filament yarns.

In various embodiments the garment ensemble has a weight of less than 10 oz/yd2. In certain embodiments the protective textile has a weight of less than 5 oz/yd2.

In further embodiments at least one of the textile layers in the ensemble has an ASTM ReF less than 20 Pa*m2/W. In some embodiments at least one of the textile layers in the ensemble has an ASTM ReF less than 5 Pa*m2/W.

In other embodiments at least one of the textile layers in the ensemble has an ASTM D737 Frazier Permeability greater than 10 ft3/ft2/min.

In various embodiments at least one of the textile layers in the ensemble has an ASTM D737 Frazier Permeability greater than 30 ft3/ft2/min. In certain embodiments at least one of the protective fabrics in the ensemble has an ASTM D737 Frazier Permeability greater than 75 ft3/ft2/min.

In certain embodiments, at least one of the textile layers has AATCC method 100 anti-microbial properties. In further embodiments the protective ensemble has abrasion resistance greater than 1,000 cycles against 400 grit using the ASTM D4966 Martindale abrasion method.

In embodiments, at least one of the textile layers has abrasion resistance greater than 5,000 cycles against 400 grit using the ASTM D4966 Martindale abrasion method.

In some embodiments, at least one of the textile layers includes both knit and woven constructions. In other embodiments, at least one of the textile layers has a 2 gr V50>350 fps using Mil Std 662F method.

In various embodiments the garment ensemble further includes a doubling feature that is a sewn or bonded applique-type pocket, said doubling feature being constructed from yarns that are similar in composition and properties to the fabric yarns of the protective textile layer.

In certain embodiments, the garment further includes a doubling feature that is one of a pleat, a gusset, or a pocket, said doubling feature being constructed from yarns that are similar in composition and properties to the fabric yarns of the protective textile layer.

A further general aspect of the present invention is a textile assembly suitable for integration into a wearable article. The textile assembly includes an outer layer having a distributed pattern of penetrations configured to facilitate load carriage, and a protective layer having filament and staple yarns, at least 25% of the yarns in the protective layer having an average tenacity of greater than 15 gpd.

In embodiments, the textile assembly has less than 2% consumption per ASTM D6413. In some embodiments, the seam holding capacity of the coated material with T-70 nylon thread at 6 stitches per inch exceeds 50 lbf of tensile strength. In other embodiments, the yarns of the protective layer include at least one layer of polymeric or elastomeric coating that substantially encapsulates the yarns of the protective layer.

In various embodiments the penetrations are approximately 1 inch long and 0.25 inches wide. In certain embodiments the outer textile layer has 2 gr frag greater than 400 fps. In further embodiments the textile assembly has a weight of less than 30 oz/sq yd.

In embodiments, the textile assembly has a thickness of less than 0.125 inches. In some embodiments, the textile assembly has a tear resistance of the penetrations when loaded with a 1 inch wide webbing as a loading strap of greater than 50 lbf. And in certain embodiments at least one of the protective textile layers has abrasion resistance greater than 20,000 cycles against 400 grit using the ASTM D4966 Martindale abrasion method.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
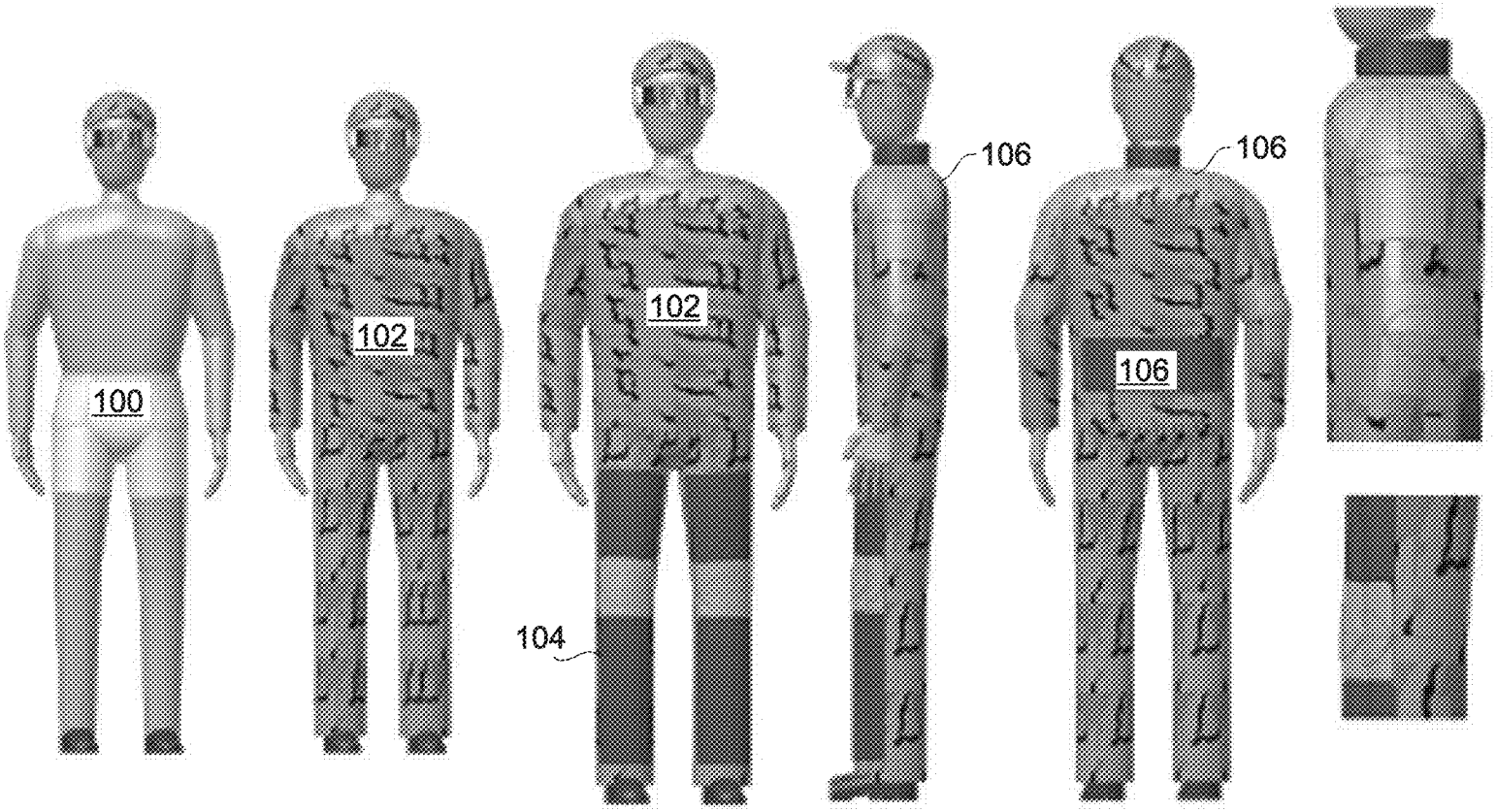
FIG. 1 illustrates an embodiment of the present invention having differing levels of protection in different areas of the body.
Figure 2:
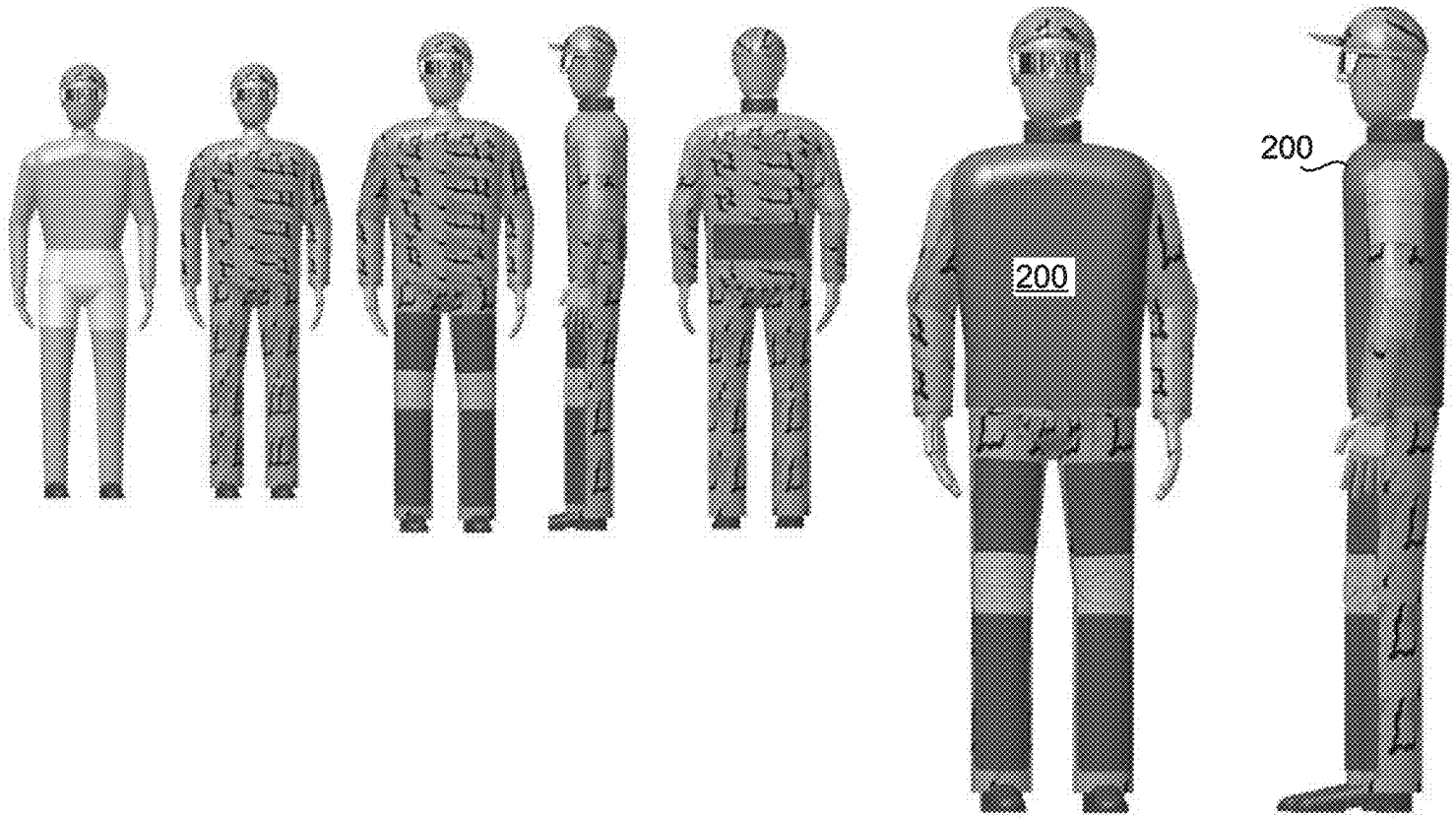
FIG. 2 illustrates an embodiment similar to FIG. 1, but further including a torso protection layer.
Figure 3A:
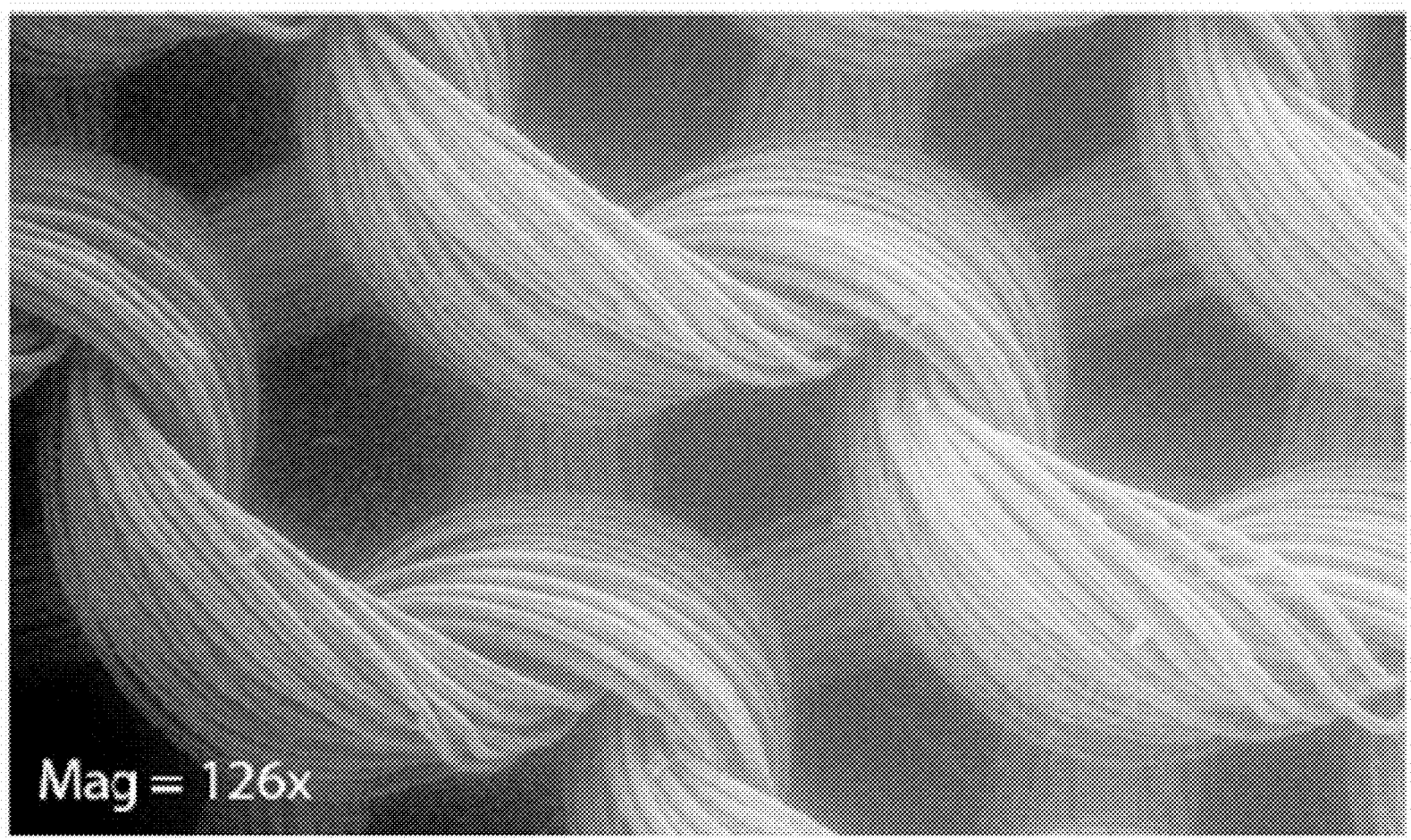
FIGS. 3A and 3B are 126× and 54× magnified images respectively, showing the inside face of a knit in an embodiment that has a weight of approximately 5 oz/yd2, the knit being configured to be soft next to skin.
Figure 3B:
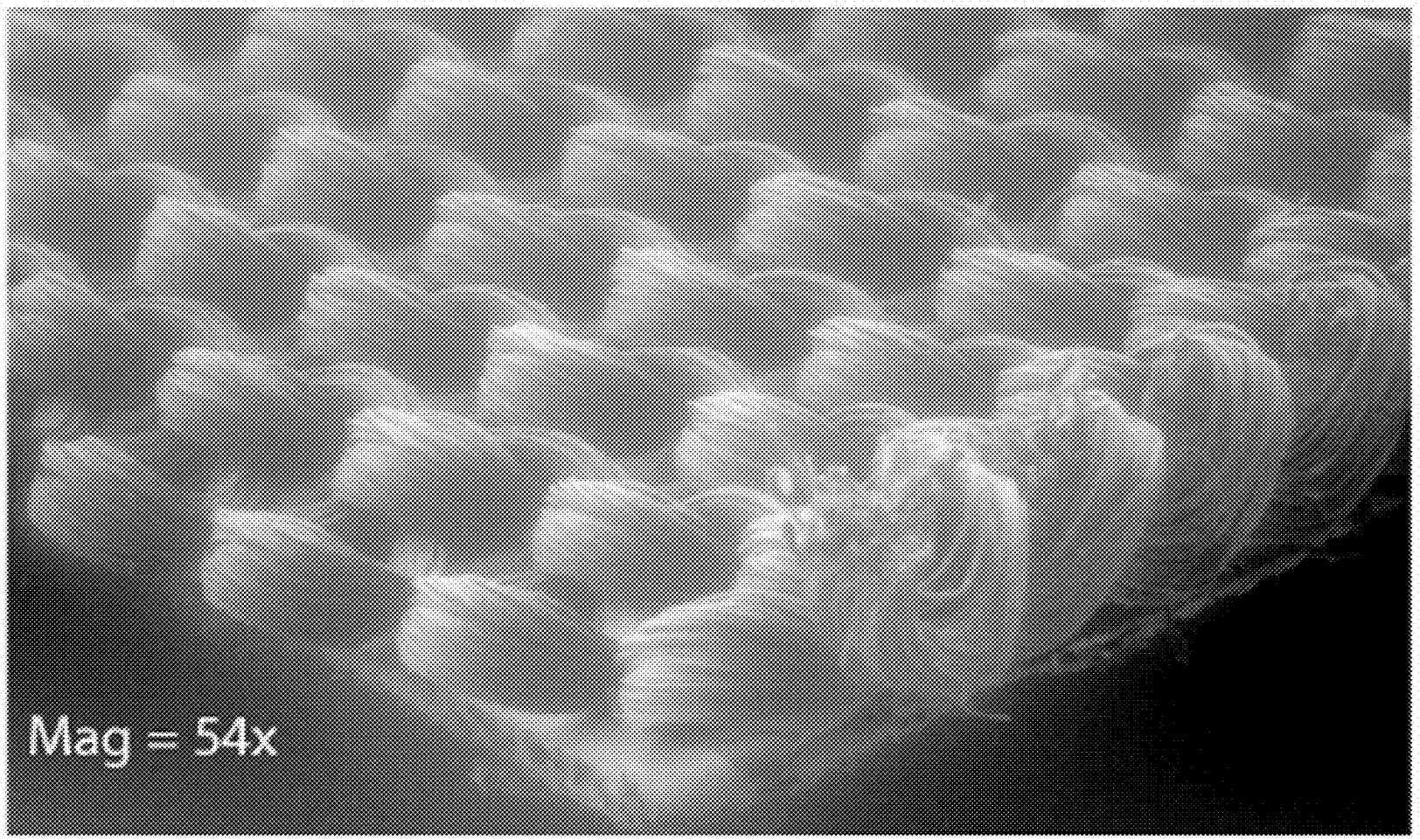
Figure 4A:
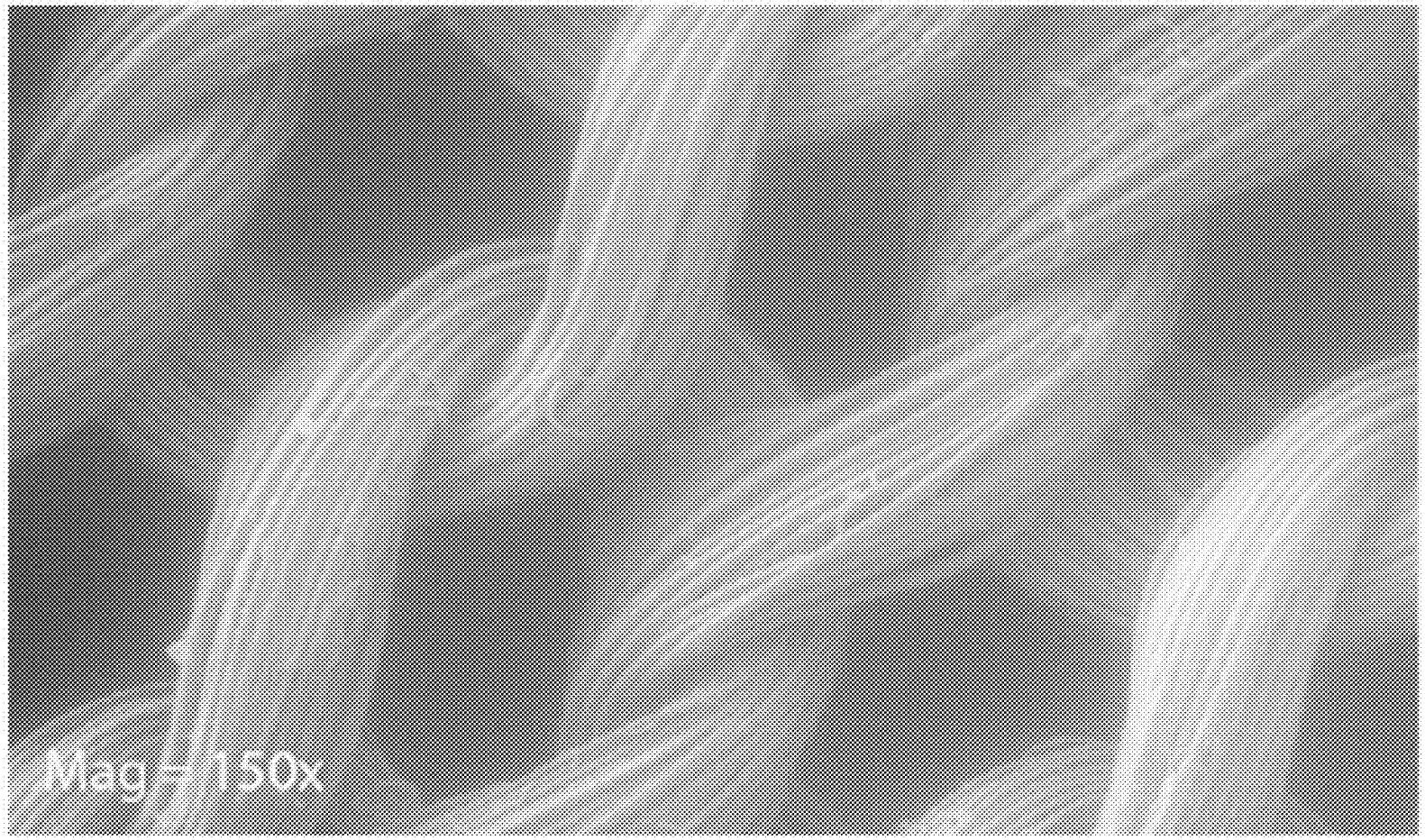
FIGS. 4A and 4B are 150c× and 56× magnified images, respectively, of the outside face of a knit in an embodiment that is more dense than the knit of FIGS. 3A and 3B, so as to provide optimal fragmentation, flame, and cut protection, while nevertheless providing a traditional knit appearance.
Figure 4B:
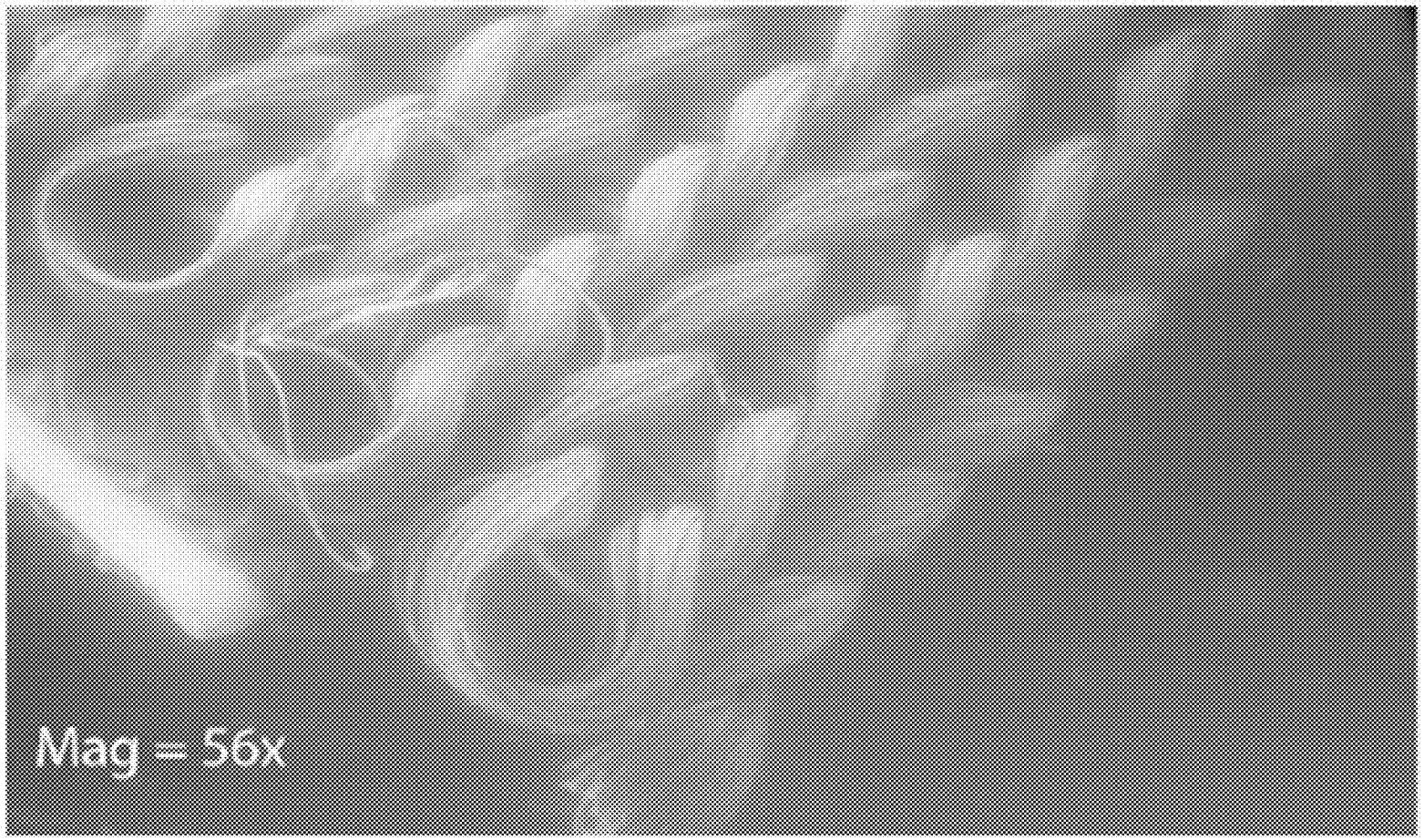

This present invention is a protective garment system fabricated from ballistic textiles that can be worn in lieu of conventional clothing to provide protection from ballistic, fragmentary, blast, cut, and abrasion threats from many sources without any added weight or discomfort to the wearer. In embodiments, the garment system incorporates layers of ballistic fabric into one or more garments, such as a t-shirt, undergarment, shirt, pant, and/or jacket. With reference to FIGS. 1 and 2, in some embodiments a plurality of protective layers is used to provide increased protection to the wearer, either by overlapping the protective articles of clothing, such as a shirt worn over a T-shirt, and/or by fabricating the individual protective garments using multiple layers of protective fabrics located in different areas of the body for greater or lesser protection.

In FIG. 1, an undergarment 100 is overlapped by a shirt and a pair of pants 102. Additional layers of fabric protection are included in the front leg area 104 of the pants and on the shoulders and upper arms 106 of the shirt, to provide added protection in these areas. FIG. 2 is similar to FIG. 1, except that the protection is further augmented by an additional torso protector 200.

Each of the technical obstacles that previously prevented the fabrication of otherwise conventional clothing from protective fabrics has been overcome. These obstacles include poor hand, poor abrasion resistance, poor color acceptance, and poor UV resistance typical of prior art protective fabrics. The features of the present invention that overcome each of these obstacles include special fiber selections and weave patterns to improve the hand, and special fabric coatings to improve the abrasion, UV resistance, and color acceptance. These features are described in more detail below.

Cut-Away Strips

Figure 10:
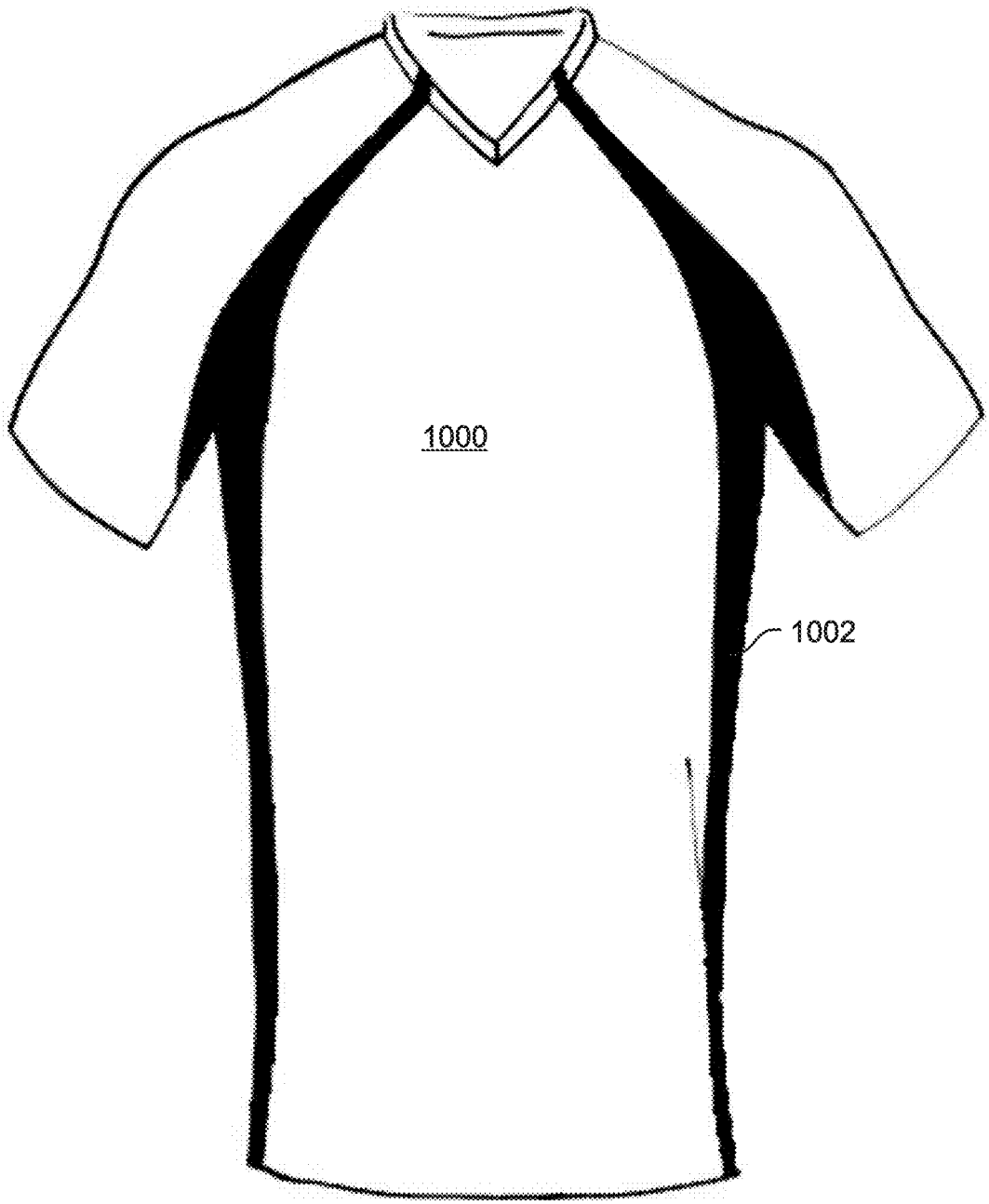
FIG. 10 is a perspective view of the front of a ballistic shirt having areas of cut-away strips.

With reference to FIG. 10, various protective garments in embodiments of the present invention include a "cut-away strip" 1002 in addition to a protective base fabric 1000 for quick release of the garment in emergency situations. Such garments can include a T-shirt, undergarment, or pant leg worn directly against the skin. A cut-away strip 1002 is defined herein as a strip of non-protective material less than 2 in wide that extends vertically from the top to the bottom of the garment, so that the strip 1002 can be easily cut with standard issue scissors, such as EMI bandage scissors, to open the garment, gain quick access beneath the garment, and/or facilitate removal of the garment from a user.

Coatings

In embodiments of the present invention, at least one coating is applied to the protective fabric that includes at least one or more of the following polymers: acrylic, urethane, isocyanate, silicone, natural rubber latex, SB rubber, neoprene, hydantoin or other N cyclics, epoxy, resorcinol, DMDHEU, urea, phenolic, melamine, or another coating material. The coatings can include inorganic and organic chromophores, flame retardants, UV stabilizers, organic and inorganic fillers, and/or viscosifiers.

In some embodiments, soft coatings are used because they do not interfere with textile hand. In other embodiments harder resins, such as resorcinol or urea resins, are used successfully at low pick weights. In some of these embodiments, the harder resin coatings are kept to less than 5% dry pick-up. The inherently softer coatings, such as acrylic or neoprene, can be used at a somewhat higher dry pick-up, however the pick-up must be limited to prevent bridging of the fabric yarns and reduction of the permeability and moisture transport of the fabric. Embodiments of the present invention can be dyed to a color having luminosity L value for light colors of less than 48, and for dark colors of less than 25.

Coating Example 1

In embodiments, the coatings include a filler and coloration system, which includes UV protective screening provided by organic and/or inorganic pigments and submicron zinc oxide and/or titanium dioxide particles in an acrylic or urethane binder. This color and filler system provides both UV resistance and chemical resistance for the coated fiber.

Coating Example 2

In some embodiments, the coating filler system used for garments that are not exposed to large amounts of UV, such as undergarments, include acrylic or urethane base coatings beneath a hydantoin topcoat that is charged with chlorine to provide both chemical resistance and antimicrobial properties to the garment. Some of these embodiments, when carrying a 150 ppm titratable chlorine charge, will self-decontaminate bacteria pathogens in less than 1 hour as measured by AATCC Method 100 antimicrobial test for textiles.

Knit Fabric of Less than 7 oz/yd2: T-Shirts and Undergarments

An example embodiment of a protective fabric that is used for inner garments that contact the skin, such as undergarments and T-shirts, is a Jersey knit fabric with an areal density of approximately 5 oz/yd2, at least 20 wales per inch, and at least 30 courses per inch, the knit being constructed using filament yarn of at least 15 gpd of 400d para-aramid. The knit has an air permeability per ASTM D737 of over 700 ft3/ft2/min, and is coated according to coating examples 1 and/or 2 described above. An example is illustrated in FIGS. 3A through 4B, which present respectively a 126× magnified image of a front side of a knit, a 54× magnified front image of the knit, a 150× magnified rear image of the knit, and a 56× magnified rear image of the knit. The inside of the knit is constructed to be soft against a user's skin, while the outside face is more dense, so as to provide improved fragmentation, flame, and cut protection, while maintaining a traditional knit appearance.

Other embodiments include a Jersey knit with at least 24 wales per inch and at least 36 courses per inch, constructed using LCP filament yarns of at least 15 gpd, and plaiting two filament yarns, one of 100d and the second of 200d. The knit has an air permeability per ASTM D737 of over 700 ft3/ft2/min. The knit is coated according to coating example 2 described above.

Other embodiments include an approximately 5 oz/yd2 Jersey knit of a para-aramid nylon with at least 35 wales per inch and at least 48 courses per inch, constructed using 2 ply staple yarns of 200d (50/2 cc) and of at least 15 gpd. The knit has an air permeability per ASTM D737 of at least 200 ft3/ft2/min. Using the mil-std-662F method for V50 calculation, the knit has a V50 against 2 gr RCC of at least 650 fps on a single ply and 850 fps with 2 ply. Embodiments are coated according to coating example 1 or 2 as described above.

Still other embodiments include an approximately 5 oz/yd2 Jersey knit of a para-aramid nylon with at least 35 wales per inch and at least 48 courses per inch, constructed using 2 ply staple yarns of 150d (70/2 cc) and of at least 15 gpd. The knit has an air permeability per ASTM D737 of at least 500 ft3/ft2/min. Using the mil-std-662F method for V50 calculation, the knit has a V50 against 2 gr RCC of at least 600 fps with 2 ply. Embodiments are coated according to coating example 1 or 2 as described above.

Other embodiments include an approximately 5 oz/yd2 Jersey knit with at least 25 wales per inch and at least 35 courses per inch, constructed using filament and staple yarns each of at least 15 gpd. The filament yarn is of 400d liquid crystal polyester ("LCP") and the staple is of 200d Para-aramid (50/2 cc). The knit has an air permeability per ASTM D737 of over 200 ft3/ft2/min. Using the mil-std-662F method for V50 calculation, the knit has a V50 against 2 gr RCC of at least 600 fps. Embodiments are coated according to coating examples 1 or 2 as described above.

Other embodiments include a Jersey knit with at least 20 wales per inch and at least 30 courses per inch, constructed by plaiting a combination of staple Para-aramid and filament Tencel yarns, each of at least 15 gpd. The knit has an air permeability per ASTM D737 of at least 100 ft3/ft2/min. Using the mil-std-662F method for V50 calculation, the knit has a V50 against 2 gr RCC of at least 700 fps. It is coated according to coating examples 1 and 2 described above.

Figure 6:
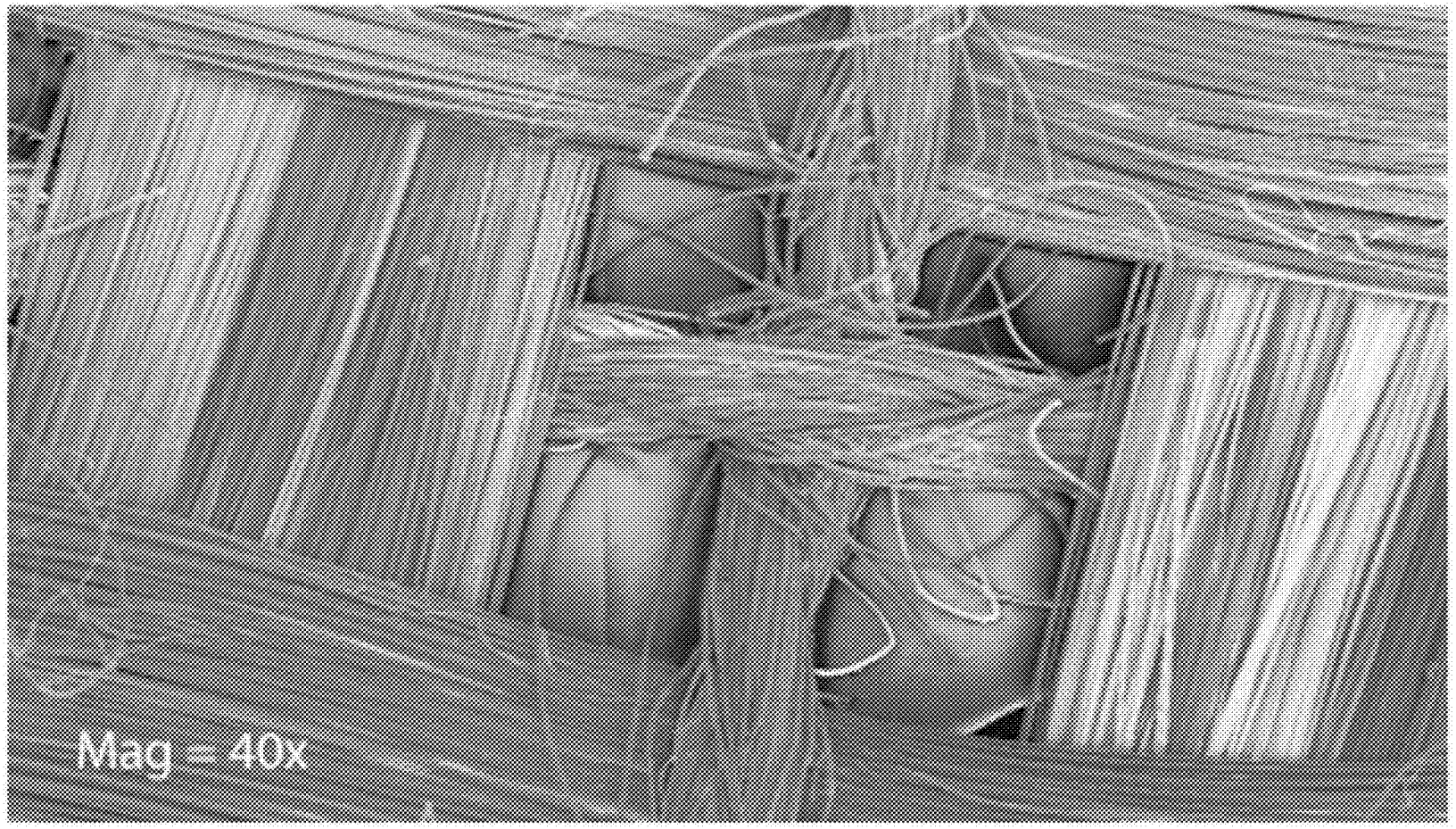
FIG. 6 is a 40× magnified image of a hybrid construction knit in an embodiment of the present invention that combines filament and staple para-aramid yarns to achieve a dense weave for enhanced ballistic fragmentation protection without use of 200d filament yarns.

FIG. 6 is a 40× magnified image of a hybrid construction that combines filament and staple para-aramid yarns to achieve a dense weave for higher ballistic and fragmentary protection, without requiring the use of 200d filament yarns.

Note that the term "plaiting" as used herein is defined as 2 yarns running parallel to each other along the wales of a knit whereas 1 yarn is always on the interior (wrong side) of the knit and 1 yarn is always on the exterior (right side) of the knit Each of these embodiments can be sewn into a garment such as a shirt or t-shirt for a male or a female. Each of these embodiments can also be sewn into boxer style shorts for a male or a female.

Each of these embodiments can be pigment/dyed. The luminosity for light colors has an L value of less than 50. The Luminosity of dark colors has an L value of less than 25.

In the prior art protective fibers have not been used for garments, especially not for garments that come into skin contact. The T-shirt or undergarment layer in embodiments of the present invention is worn directly against the skin for long periods of time, without negative impact. The T-shirt or undergarment is fabricated of a knit material constructed with staple yarns, filament yarns, or a combination of both yarn types. In various embodiments, the fiber types include para-aramid, LCP, UHMWPE, and/or other fibers having an average tenacity that is greater than 12 gpd. In embodiments, the textile weight of the T-shirt or undergarment is below 7 oz/yd2.

The knit of the T-shirt or undergarment can be plied during the knitting process with multiple yarns, where the yarns are either of staple yarns, filament yarns, or a combination of both. The knit can be used as a single ply, or layered in multiple plies within a single garment to achieve the required performance. The knit is then sewn into a garment such as a T-shirt or undergarment for a male or a female.

Woven or Knit Inner Layer of Less Than 7 oz/yd2: Mid Layer Garments (Shirts)

In embodiments, mid-layer garments such as shirts are made from a woven protective fabric having an areal density of approximately 3.6 oz/yd2. In a typical example the woven is a basket weave with at least 50 warp yarns per inch and at least 80 fill yarns per inch, constructed using staple yarns of at least 15 gpd. In this example, the fabric is coated according to coating example 1 discussed above. The woven has an air permeability per ASTM D737 of at least 65 ft3/ft2/min and 3.5 Ref via ASTM F1868E. And the flame performance per ASTM D6413 is less than 3% consumption with no melt or drip.

This embodiment has an average of 2.7 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 1 lbf in warp, fill, and bias directions. When a test specimen is held securely in place and a 5 mm chisel is lowered at a perpendicular angle to the test specimen at a rate of 20 in/min, the puncture resistance measured is at least 25 lbf in warp, fill, and bias directions. When a test specimen is held securely in place and a 5 mm plunger is lowered at a perpendicular angle to the test specimen at a rate of 20 in/min, the puncture resistance measured is at least 100 lbf in warp, fill, and bias directions.

In embodiments, mid-layer garments such as shirts are made from a woven protective fabric having an areal density of approximately 3.1 oz/yd2. In a typical example, the woven is a plain weave with at least 80 warp yarns per inch and at least 60 fill yarns per inch, constructed using staple yarns of at least 15 gpd. In this example, the fabric is coated according to coating example for 2 discussed above. The woven has an air permeability per ASTM D737 of at least 30 ft3/ft2/min and 17 Ref via ASTM F1868E. And the flame performance per ASTM D6413 is less than 3% consumption with no melt or drip. Some of these embodiments have a V50 against 2 gr RCC of at least 600 fps.

Figure 5A:
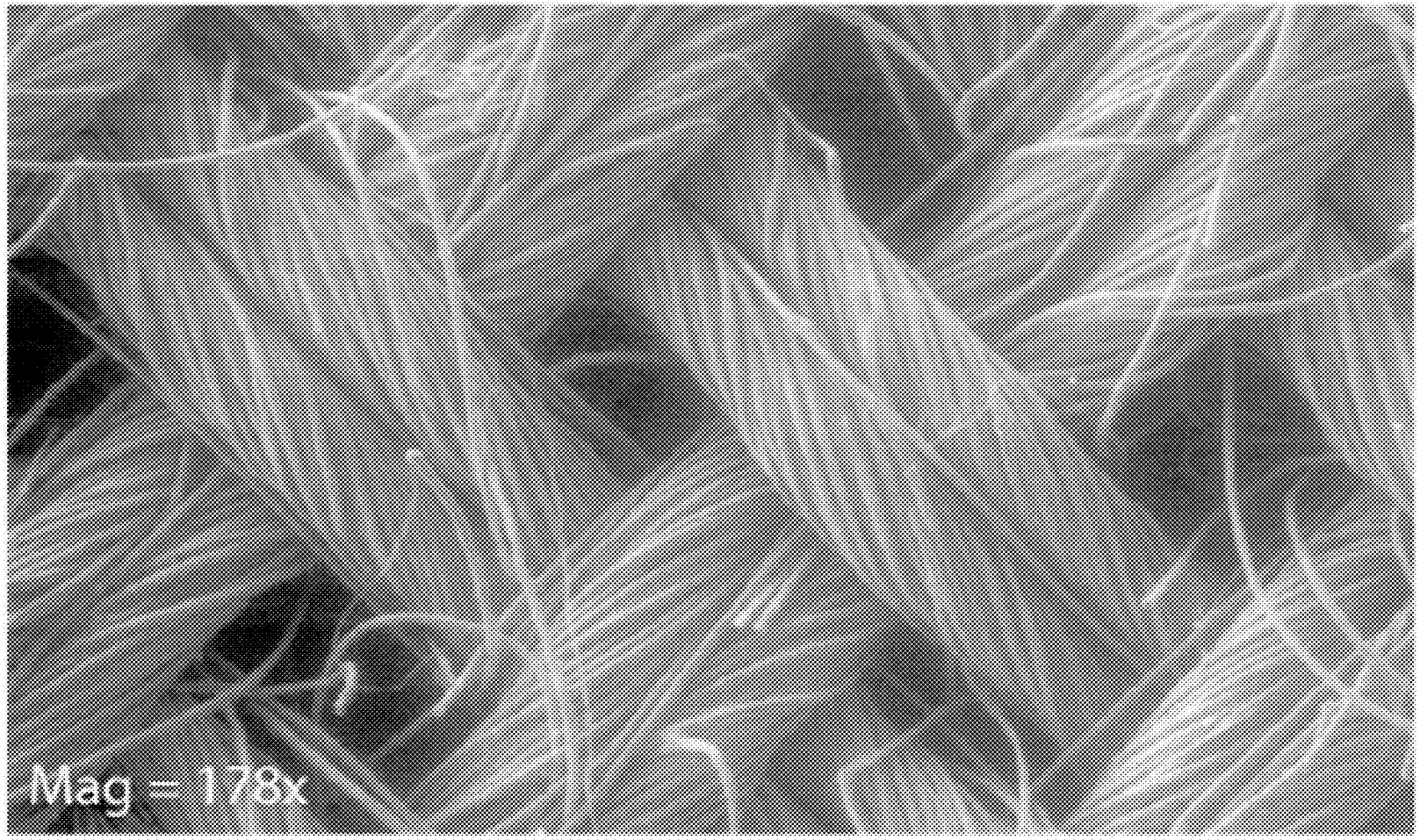
FIGS. 5A and 5B are 178× and 51× magnified images, respectfully, of the outside face of a woven that has the look and feel of conventional uniform shirt fabric, but can be the basis for a shirt with enhanced fragmentation, flame, and cut protection.
Figure 5B:
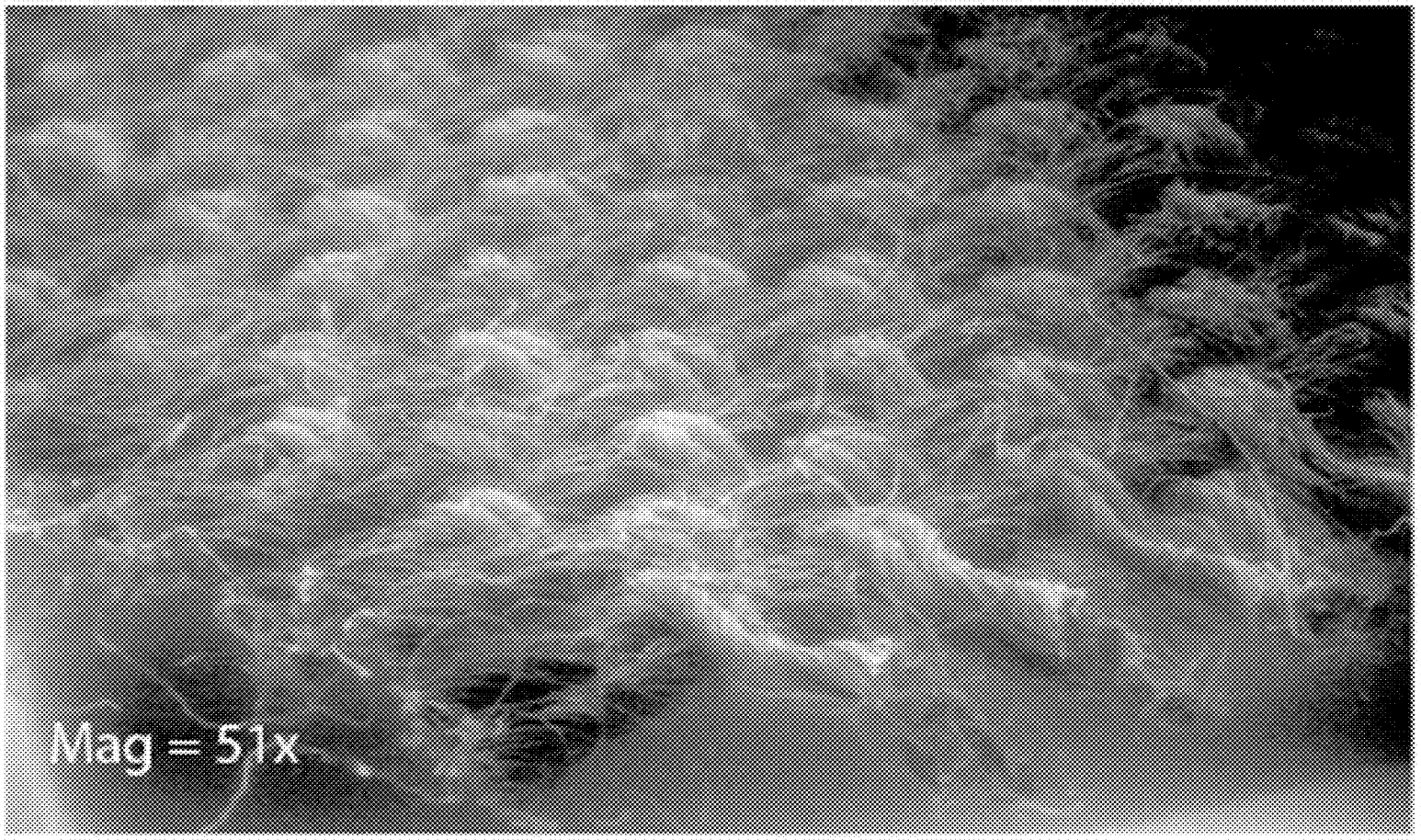

FIGS. 5A and 5B are respectively a 178× magnified front image and a 51× magnified image of a woven in an embodiment of the present invention that has the look and feel of a conventional uniform shirt, but provides enhanced fragmentary, flame, and cut protection.

Another typical example embodiment is a Jersey knit with an areal density of 7 oz/yd2, and with 45 courses/in and 34 wales/in. The knit is constructed by plaiting a staple yarn of at least 100d and a tenacity of at least 15 gpd with a stretch yarn of less than 40d and having at least 300% stretch to break. The plaited knit has less than 30% stretch yarn when compared to the total knit areal density. It is coated according to coating example 1 discussed above. The knit has an air permeability of 100 ft3/ft2/min per ASTM D737. The flame resistance of the knit per ASTM D6413 has no melt or drip and less than 2% consumption. The V50 against 2 gr RCC using the mil std 662F method for V50 calculation is over 750 fps.

Yet another example embodiment is a Jersey knit with an areal density of approximately 9 oz/yd2 with 11 courses/in and 13 wales/in. The knit is constructed using 1000d filament yarn of at least 15 gpd. The knit has an air permeability per ASTM D737 of at least 700 ft3/ft2/min and less than 2 Ref via ASTM F1868E.

Each of these knits can be sewn into a garment such as a shirt for a male or a female, and can be dyed. The luminosity for light colors can have an L value of less than 50. The Luminosity of dark colors can have an L value of less than 25.

Figure 7A:
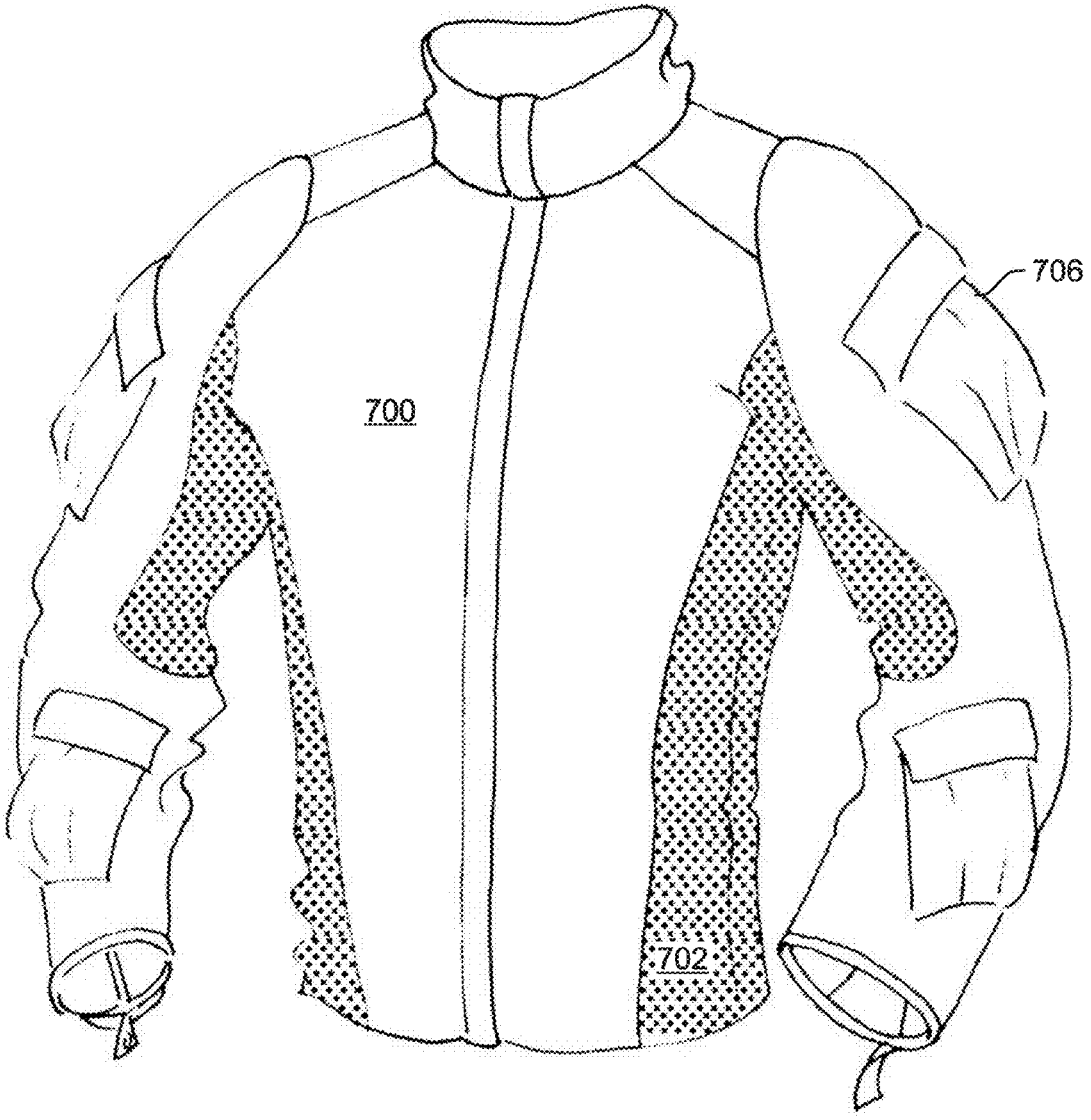
FIG. 7A is a perspective view of the front side of a ballistic shirt having areas that differ in protection and air permeability from the base fabric areas.
Figure 7B:
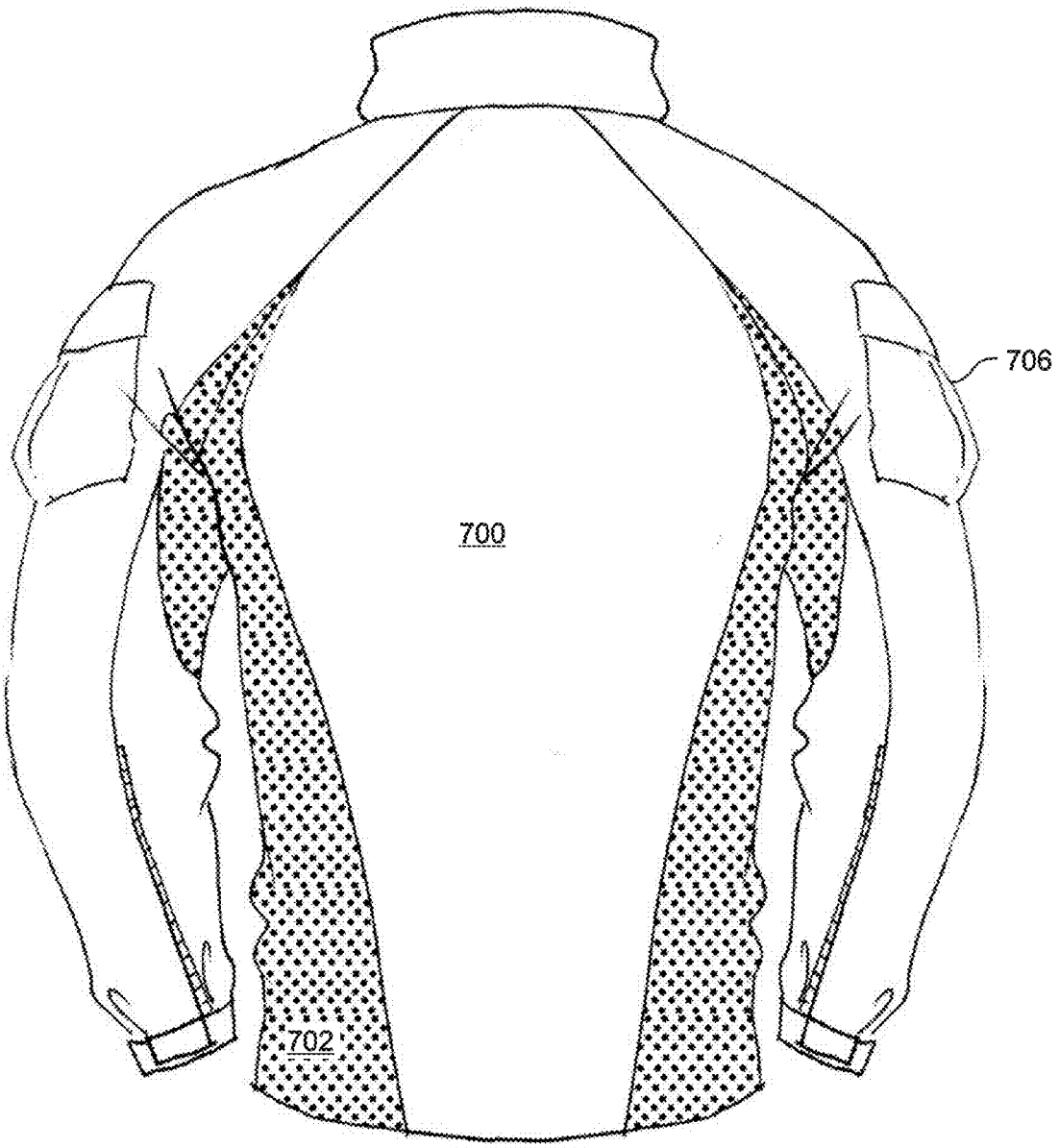
FIG. 7B is a perspective view of the back side of FIG. 7A.

FIGS. 7A and 7B illustrate the front and back sides respectively of a shirt in an embodiment of the invention that includes a protective base fabric 700 having differing protection layers 702, All features of the shirt are protective, including the pockets 706.

Woven Outer Layer of Less than 15 oz/yd2: Pant/Jacket:

An example embodiment of a protective fabric used for outer garments is a twill that is woven using filament yarns of at least 15 gpd in the warp direction on the inside of the fabric and staple yarns of at least 15 gpd in the filling direction on the outside of the fabric, with an areal density of approximately 8 oz/yd2. The staple yarns are 300d and the filament yarns are 200d. The woven has 110 warp yarns per inch and 60 fill yarns per inch. This example is coated according to coating example 1 as described above. The woven has an air permeability per ASTM D737 of at least 20 ft3/ft2/min and 6 Ref via ASTM F1868E. The flame performance per ASTM D6413 is less than 2% consumption and no melt or drip.

This example has an average of 6 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 2 lbf in warp, fill, and bias directions. When a test specimen is held securely in place and a 5 mm chisel is lowered at a perpendicular angle to the test specimen at a rate of 20 in/min, the puncture resistance measured is at least 45 lbf in warp, fill, and bias directions. When a test specimen is held securely in place and a 5 mm plunger is lowered at a perpendicular angle to the test specimen at a rate of 20 in/min, the puncture resistance measured is at least 150 lbf in warp, fill, and bias directions. The abrasion resistance per ASTM D4966 against a 400 grit abrasive is 6000 cycles before yarn break. The V50 against 2 gr RCC using the mil std 662F method for V50 calculation is over 350 fps An example embodiment of a protective fabric used for outer garments is a twill that is woven using filament yarns of at least 15 gpd in the fill direction on the inside of the fabric, and staple yarns of at least 15 gpd in the warp direction on the outside of the fabric, with an areal density of approximately 8 oz/yd2. The staple yarns are approximately 400d and the filament yarns are approximately 500d. The woven has 52 warp yarns per inch and 68 fill yarns per inch. This example is coated according to coating example 1 as described above. The woven has an air permeability per ASTM D737 of at least 15 ft3/ft2/min. The flame performance per ASTM D6413 is less than 2% consumption and no melt or drip. This embodiment has a V50 against 2 gr RCC using the mil std 662F method for V50 calculation of over 790 fps Another example embodiment of a protective fabric used for outer garments is a twill that is woven using filament yarns of at least 15 gpd in the warp direction on the inside of the fabric and staple yarns of at least 15 gpd in the filling direction on the outside of the fabric, with an areal density of approximately 8 oz/yd2. The staple yarns are approximately 400d and the filament yarns are approximately 500d. The woven has 72 warp yarns per inch and 52 fill yarns per inch. This example is coated according to coating example 1 as described above. The woven has an air permeability per ASTM D737 of at least 15 ft3/ft2/min. The flame performance per ASTM D6413 is less than 2% consumption and no melt or drip. This embodiment has a V50 against 2 gr RCC using the mil std 662F method for V50 calculation of over 790 fps Another example embodiment is a twill that is woven using staple yarns of at least 15 gpd in the warp direction on the outside of the fabric and filament yarns of at least 15 gpd in the filling direction on the inside of the fabric, with an areal density of approximately 15 oz/yd2. The staple yarns are 400d and the filament yarns are 500d. The woven has 60 warp yarns per inch and 110 fill yarns per inch. This example is coated according to coating example 1 discussed above. The woven has an air permeability per ASTM D737 of at least 15 ft3/ft2/min and 6 Ref via ASTM F1868E. The flame performance per ASTM D6413 is less than 2% consumption and no melt or drip.

This example embodiment has an average of 6 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 2 lbf in warp, fill, and bias directions. When a test specimen is held securely in place and a 5 mm chisel is lowered at a perpendicular angle to the test specimen at a rate of 20 in/min, the puncture resistance measured is at least 45 lbf in warp, fill, and bias directions. When a test specimen is held securely in place and a 5 mm plunger is lowered at a perpendicular angle to the test specimen at a rate of 20 in/min, the puncture resistance measured is at least 150 lbf in warp, fill, and bias directions. The abrasion resistance per ASTM D4966 against a 400 grit abrasive is 6000 cycles before yarn break. The V50 against 2 gr RCC using the mil std 662F method for V50 calculation is over 800 fps and over 1000 fps against 16 gr RCC.

Another example embodiment is a twill that is woven using filament yarns of at least 15 gpd in the warp direction on the inside of the fabric and staple yarns of at least 15 gpd in the filling direction on the outside of the fabric, with an areal density of approximately 15 oz/yd2. The staple yarns are 400d and the filament yarns are 500d. The woven has 110 warp yarns per inch and 60 fill yarns per inch. The woven has an air permeability per ASTM D737 of at least 15 ft3/ft2/min and 6 Ref via ASTM F1868E. The flame performance per ASTM D6413 is less than 2% consumption and no melt or drip.

This example has an average of 6 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 2 lbf in warp, fill, and bias directions. When a test specimen is held securely in place and a 5 mm chisel is lowered at a perpendicular angle to the test specimen at a rate of 20 in/min, the puncture resistance measured is at least 45 lbf in warp, fill, and bias directions. When a test specimen is held securely in place and a 5 mm plunger is lowered at a perpendicular angle to the test specimen at a rate of 20 in/min, the puncture resistance measured is at least 150 lbf in warp, fill, and bias directions. The abrasion resistance per ASTM D4966 against a 400 grit abrasive is 6000 cycles before yarn break. The V50 against 2 gr RCC using the mil std 662F method for V50 calculation is over 800 fps and over 1000 fps against 16 gr RCC.

Yet another example embodiment is a satin woven using staple yarns of at least 15 gpd in the warp direction on the outside of the fabric and filament yarns of at least 15 gpd in the filling direction on the inside of the fabric, with an areal density of approximately 15 oz/yd2. The weave is 110 warp yarns by 52 fill yarns. The staple yarns are 400d and the filament yarns are 500d. The woven has an air permeability per ASTM D737 of at least 15 ft3/ft2/min and 7 Ref via ASTM F1868E. The flame performance per ASTM D6413 is less than 3% consumption and no melt or drip.

This embodiment has an average of 8.5 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 2.5 lbf in warp, fill, and bias directions. When a test specimen is held securely in place and a 5 mm chisel is lowered at a perpendicular angle to the test specimen at a rate of 20 in/min, the puncture resistance measured is at least 85 lbf in warp, fill, and bias directions. When a test specimen is held securely in place and a 5 mm plunger is lowered at a perpendicular angle to the test specimen at a rate of 20 in/min, the puncture resistance measured is at least 320 lbf in warp, fill, and bias directions. The abrasion resistance per ASTM D4966 against a 400 grit abrasive is 7100 cycles before yarn break. The V50 against 2 gr RCC using the mil std 662F method for V50 calculation is over 800 fps and over 1000 fps against 16 gr RCC.

Still another example embodiment is a twill that is woven using staple yarns spun with 3% of the fibers having less than 10 gpd and 97% fibers having at least 15 gpd in the warp direction on the outside of the fabric and filament yarns of at least 15 gpd in the filling direction on the inside of the fabric, with an areal density of approximately 15 oz/yd2. The weave is 50 warp yarns by 110 fill yarns. The woven has an air permeability per ASTM D737 of at least 15 ft3/ft2/min and 6 Ref via ASTM F1868E. The flame performance per ASTM D6413 is less than 2% consumption and no melt or drip. This embodiment has an average of 6 lbf of puncture resistance against Probe A via ASTM F1342. When a test specimen is held securely in place and a #10 Scalpel blade is lowered at a perpendicular angle to the test specimen at a rate of 20 in/min, the puncture resistance measured is at least 2 lbf in warp, fill, and bias directions.

When a test specimen is held securely in place and a 5 mm chisel is lowered at a perpendicular angle to the test specimen at a rate of 20 in/min, the puncture resistance measured is at least 45 lbf in warp, fill, and bias directions. When a test specimen is held securely in place and a 5 mm plunger is lowered at a perpendicular angle to the test specimen at a rate of 20 in/min, the puncture resistance measured is at least 150 lbf in warp, fill, and bias directions. The abrasion resistance per ASTM D4966 against a 400 grit abrasive is 10,000 cycles before yarn break. The V50 against 2 gr RCC using the mil std 662F method for V50 calculation is over 800 fps and over 1000 fps against 16 gr RCC.

An embodiment is a textile assembly that is used for load carriage. This embodiment has a protective elastomeric or pigment coating. The embodiment is a hybrid woven, using both filament and staple yarns of at least 15 gpd. The garment is constructed by penetrating the textile with penetrations of at least 1 in×0.25 in, spaced such that items can be temporarily fastened to the ensemble. This embodiment can be attached, sewn, or bonded to other garments or non-garments such as backpacks. The embodiment provides greater than 600 fps 2 gr RCC protection using Mil Std 662F. Areal density is 20 oz/yd2 and 0.025 in thick.

For this embodiment, when tested using ASTM D5035, the average warp tensile is at least 280 lbf, and the average fill is at least 730 lbf. When tested against ASTM D5034 for tear, the average warp or fill is 100 lbf.

For this embodiment, when a perforation is pulled vertically straight down using a piece of 1 inch wide nylon webbing, the tear resistance of the perforation is 126 lbf.

Each of these embodiments can be sewn into a garment such as a pant, shirt, or jacket for a male or a female, and can be dyed. The luminosity for light colors has an L value of less than 50. The Luminosity of dark colors has an L value of less than 25.

Figure 8A:
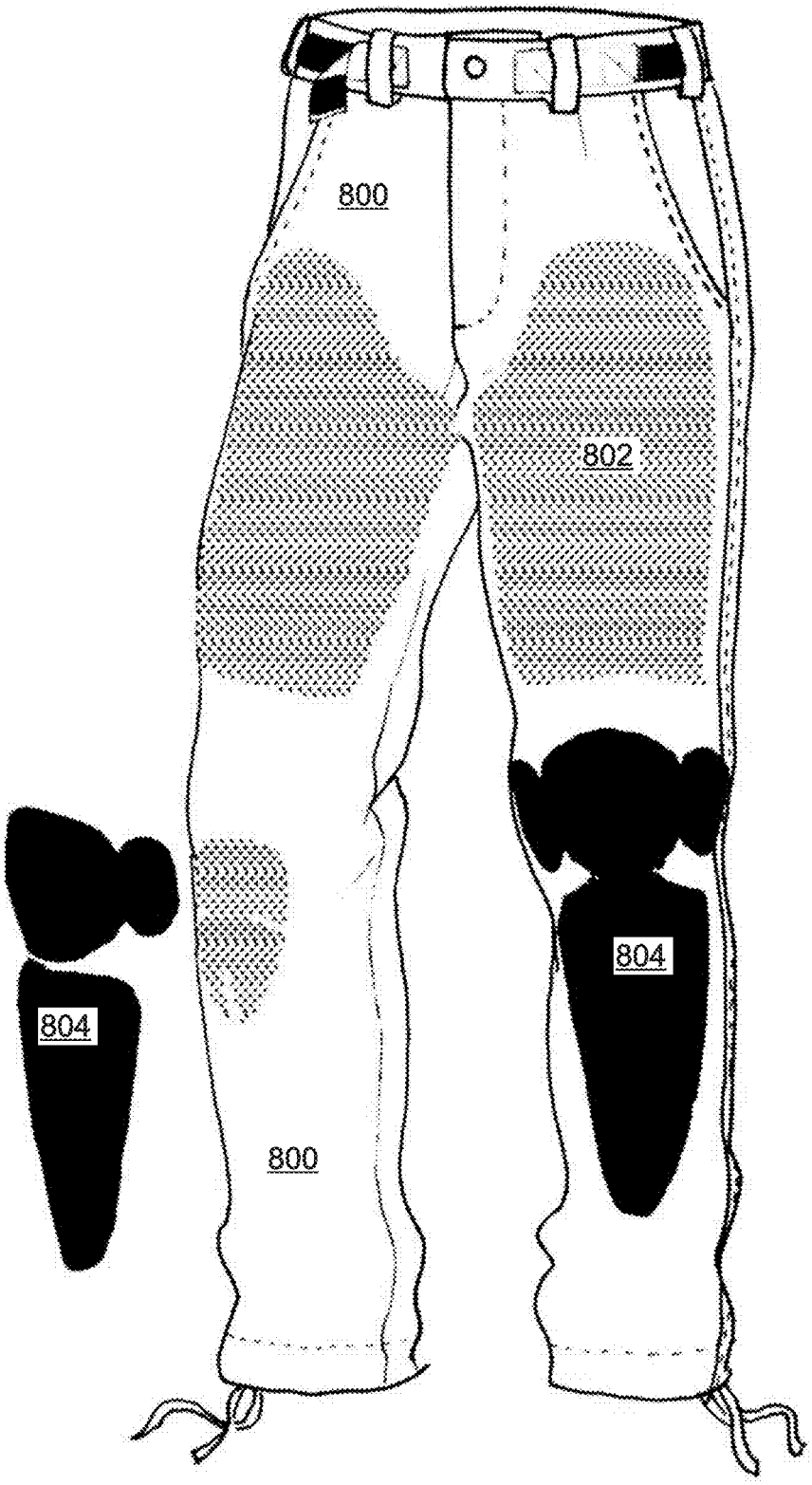
FIG. 8A is a perspective view of the front side of a ballistic pant with areas of higher protection than the base fabric areas.
Figure 8B:
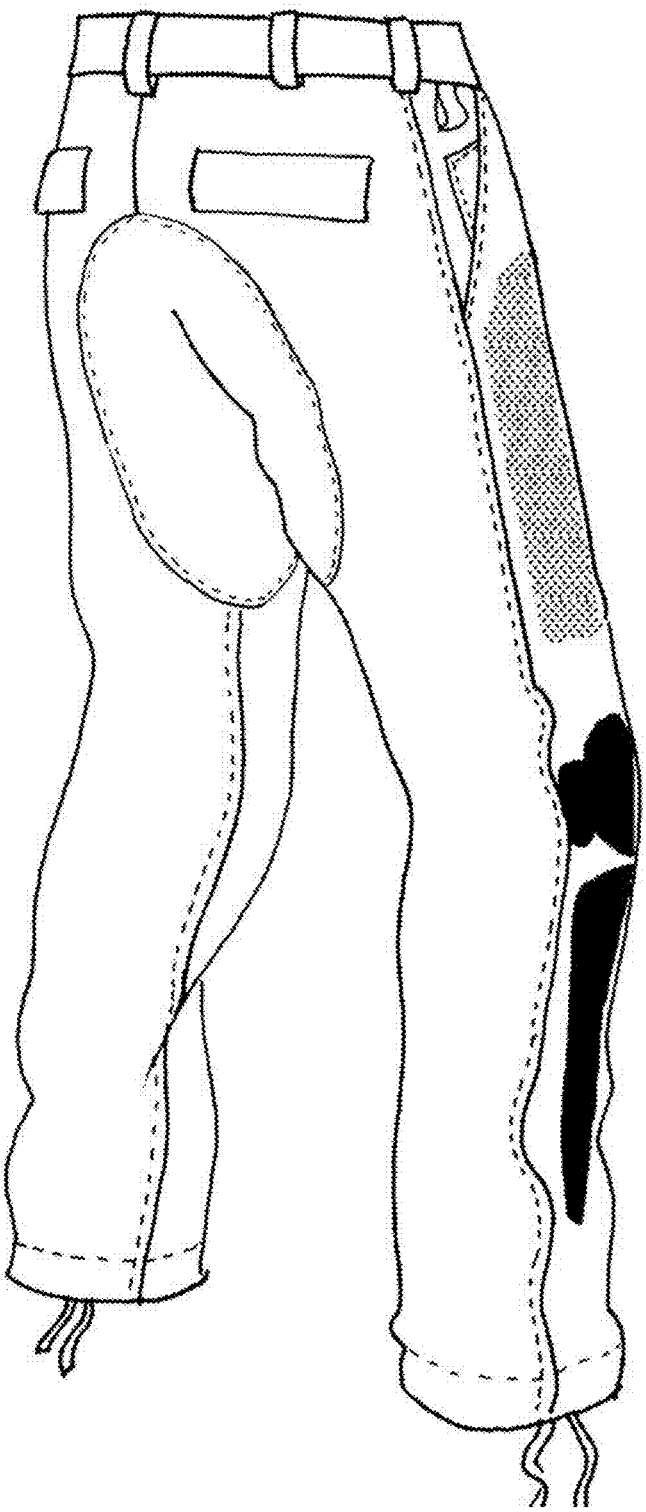
FIG. 8B is a perspective view of the back side of FIG. 8A.
Figure 9:
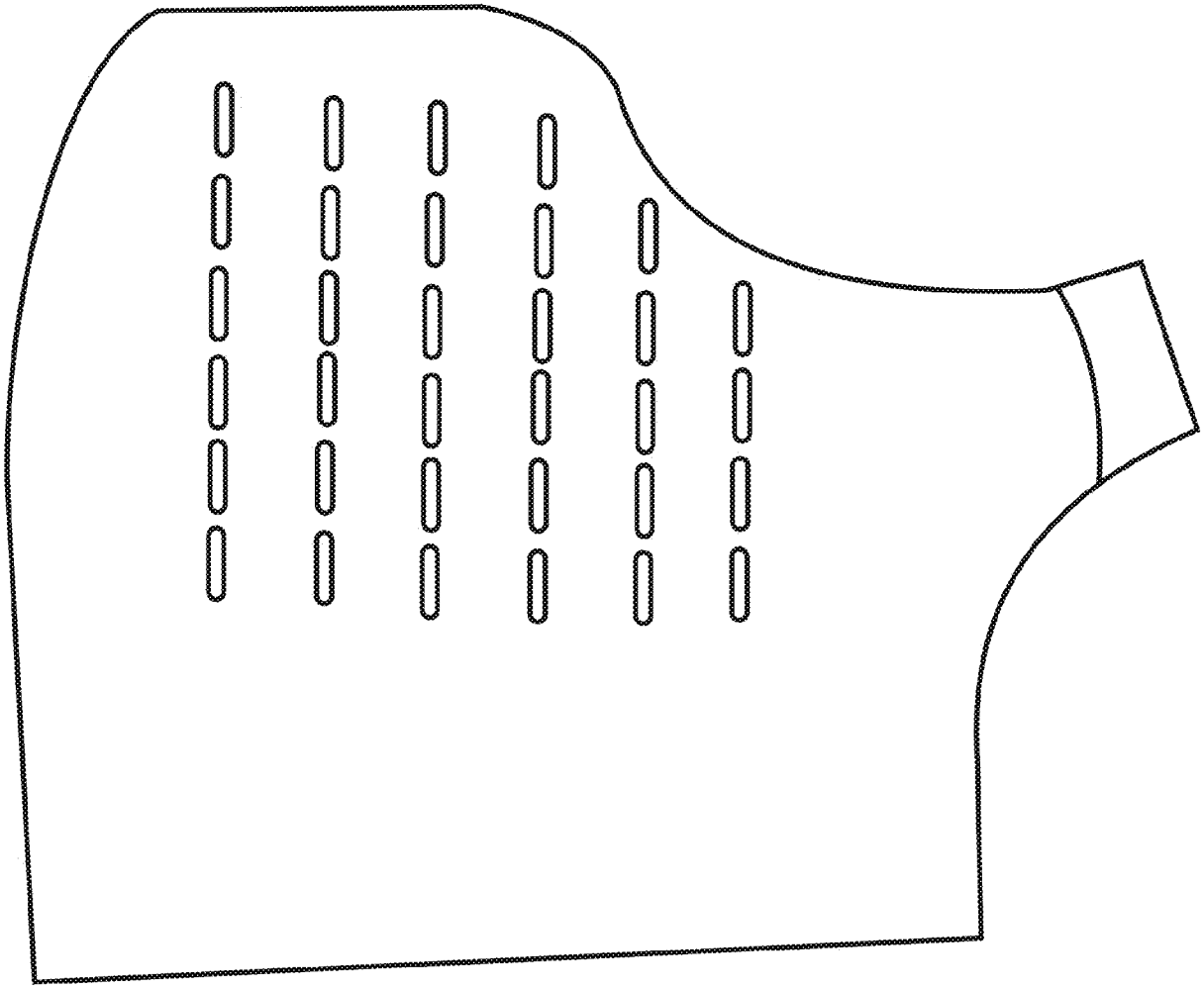
FIG. 9 is an image of a textile assembly used for load carriage made of protective material according to an embodiment of the present invention.

FIGS. 8A and 8B are front and rear illustrations, respectively, of a pair of pants including a protective base fabric 800 and additional protective layers 802, 804 positioned to protect critical areas of the user's body.

Garment and Ensemble Configurations

The novelty of the present invention is based at least partly on the use of little or no non-protective textile in the ensemble. In addition, the invention uses all the layers of a typical non-protective clothing ensemble to provide to the wearer the maximum protection with the minimum mass and potential for unnecessary heat stress. Embodiments of the present invention use most or all of the garment design features for added protection. For example, in embodiments:

Pockets are fabricated of protective textiles

Jacket liners are fabricated of protective textiles

Jacket stiffeners are fabricated of protective textiles

Collars and/or lapels are fabricated of protective textiles

Pleats or darts provide an added layer of protective textile

These design elements all make use of garment features that are required by users for the normal operation and appearance of the garment, while at the same time providing additional protection to the user.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A garment ensemble configured to cover a chest, back, thigh, and butt area of a user, the garment comprising:

A plurality of textile layers, configured such that no textile layer covering the chest, back, thigh, or butt area provides less than 300 fps V50 protection against 2 gr RCC fragment tested per Mil-Std 662F; and at least 2 protective layers in the ensemble having greater than 2 gr RCC 300 fps V50, each of the textile layers having a conformal coating layer.

2. The garment ensemble of claim 1, wherein the garment ensemble can be dyed to a color having luminosity L less than 70.

3. The garment ensemble of claim 1, wherein at least one of the textile layers is a knit that is plied with a plurality of yarns, at least one of said yarns being a staple yarn.

4. The garment ensemble of claim 1, wherein at least one of the textile layers is a knit that is plied with a plurality yarns, at least some of said yarns being filament yarns.

5. The garment ensemble of claim 1, wherein the garment ensemble has a weight of less than 10 oz/yd2.

6. The garment ensemble of claim 1, wherein the protective textile has a weight of less than 5 oz/yd2.

7. The garment ensemble of claim 1, wherein at least one of the textile layers in the ensemble has an ASTM ReF less than 20 Pa*m2/W.

8. The garment ensemble of claim 1, wherein at least one of the textile layers in the ensemble has an ASTM ReF less than 5 Pa*m2/W.

9. The garment ensemble of claim 1, wherein at least one of the textile layers in the ensemble has an ASTM D737 Frazier Permeability greater than 10 ft3/ft2/min.

10. The garment ensemble of claim 1, wherein at least one of the textile layers in the ensemble has an ASTM D737 Frazier Permeability greater than 30 ft3/ft2/min.

11. The garment ensemble of claim 1, wherein at least one of the protective fabrics in the ensemble has an ASTM D737 Frazier Permeability greater than 75 ft3/ft2/min.

12. The garment ensemble of claim 1, wherein at least one of the textile layers has AATCC method 100 anti-microbial properties.

13. The garment ensemble of claim 1, wherein the protective ensemble has abrasion resistance greater than 1,000 cycles against 400 grit using the ASTM D4966 Martindale abrasion method.

14. The garment ensemble of claim 1, wherein at least one of the textile layers has abrasion resistance greater than 5,000 cycles against 400 grit using the ASTM D4966 Martindale abrasion method.

15. The garment ensemble of claim 1, wherein at least one of the textile layers includes both knit and woven constructions.

16. The garment ensemble of claim 1, wherein at least one of the textile layers has a 2 gr V50>350 fps using Mil Std 662F method.

17. The garment ensemble of claim 1, wherein the garment ensemble further includes a doubling feature that is a sewn or bonded applique-type pocket, said doubling feature being constructed from yarns that are similar in composition and properties to the fabric yarns of the protective textile layer.

18. The garment ensemble of claim 1, wherein the garment further includes a doubling feature that is one of a pleat, a gusset, or a pocket, said doubling feature being constructed from yarns that are similar in composition and properties to the fabric yarns of the protective textile layer.

* * * * *